US008011528B2

(12) United States Patent
Wright

(10) Patent No.: US 8,011,528 B2
(45) Date of Patent: Sep. 6, 2011

(54) LATERALLY EXPANDABLE RECEPTACLE

(76) Inventor: Ray Wright, Melbourne, FL (US)

( * ) Notice: Subject to any disclaimer, the term of this patent is extended or adjusted under 35 U.S.C. 154(b) by 453 days.

(21) Appl. No.: 12/002,192

(22) Filed: Dec. 14, 2007

(65) Prior Publication Data

US 2009/0152273 A1 Jun. 18, 2009

(51) Int. Cl.

| | |
|---|---|
| ***B65D 6/00*** | (2006.01) |
| ***B65D 8/04*** | (2006.01) |
| ***B65D 8/18*** | (2006.01) |
| ***B65D 90/02*** | (2006.01) |

(52) U.S. Cl. ..... 220/666; 220/9.1; 220/495.08

(58) Field of Classification Search ..... 220/9.1, 220/9.3, 495.06, 495.08, 495.11, 676, 666
See application file for complete search history.

(56) References Cited

U.S. PATENT DOCUMENTS

| | | | | | |
|---|---|---|---|---|---|
| 1,555,115 | A | | 9/1925 | Hand | |
| 3,148,799 | A | | 9/1964 | Meroney | |
| 4,054,225 | A | * | 10/1977 | Frech | 220/495.04 |
| 4,294,379 | A | | 10/1981 | Bard | |
| 4,320,851 | A | * | 3/1982 | Montoya | 220/324 |
| 4,715,572 | A | * | 12/1987 | Robbins et al. | 248/101 |
| 4,764,029 | A | | 8/1988 | Abblett | |
| 4,903,575 | A | * | 2/1990 | Capawana | 89/34 |
| 4,917,254 | A | | 4/1990 | Ciriacks | |
| 4,951,831 | A | * | 8/1990 | Roesch et al. | 220/676 |
| 5,163,579 | A | | 11/1992 | Jones | |
| 5,220,866 | A | | 6/1993 | Mason, Jr. et al. | |
| 5,375,732 | A | | 12/1994 | Bowers et al. | |
| 5,390,812 | A | | 2/1995 | Spiro | |
| 5,390,818 | A | * | 2/1995 | LaBuda | 220/676 |
| 5,492,241 | A | | 2/1996 | Barnett et al. | |
| 5,960,983 | A | | 10/1999 | Chan | |
| 6,015,063 | A | | 1/2000 | Poliquin | |
| 6,056,147 | A | * | 5/2000 | Jarman | 220/495.11 |
| 6,102,343 | A | | 8/2000 | Grimesey et al. | |
| 6,126,031 | A | * | 10/2000 | Reason | 220/495.07 |
| 6,594,876 | B1 | | 7/2003 | Stastny | |
| 7,077,571 | B1 | | 7/2006 | Wilson | |
| 2002/0112614 | A1 | * | 8/2002 | Zoss | 99/426 |
| 2006/0056741 | A1 | * | 3/2006 | Yang et al. | 383/33 |

* cited by examiner

*Primary Examiner* — Harry A Grosso
(74) *Attorney, Agent, or Firm* — Hayworth, Chaney & Thomas; Robert A. Lynch, Esq.; Stephen C. Thomas, Esq.

(57) ABSTRACT

A laterally expandable receptacle wherein a greater volume of items, such as trash, linen, laundry, recyclables, grain, and the like, may be contained as compared to conventional receptacles. Side walls and/or corners of the receptacle may comprise resilient expansion means allowing for beneficial lateral displacement. The resilient expansion means may be selected from a variety of structures including, at least one pleat, an accordion configuration, at least one slit, at least one aperture, an expandable material, an expandable material covering at least one aperture, flexible cords, and all legal equivalents thereof. The receptacle of the present invention may further comprise a pressure release means to eliminate a vacuum seal from forming between the receptacle and an optional replaceable liner therein. The receptacle of the present invention may still further comprise a stabilization means for providing a necessary stabilizing force against the receptacle during liner removal.

17 Claims, 8 Drawing Sheets

LATERALLY EXPANDABLE RECEPTACLE

CROSS REFERENCE TO RELATED APPLICATIONS

Not applicable.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention generally relates to expandable receptacles, more specifically, the present invention relates to laterally expandable receptacles that are capable of containing a greater volume of inserted items as compared to receptacles currently found in the prior art.

2. Background Art

Trash receptacles, also known as refuse containers, are used in practically every home and business in the United States. These receptacles take many forms, from small, indoor waste paper baskets to large, outdoor garbage cans. A large majority of these receptacles utilize a replaceable liner that is placed inside of a metal or plastic housing. The user fills the refuse liner with garbage, and when the liner is full, the user removes the liner from the housing and disposes of it, thereafter placing a new liner in the housing. Examples of such trash receptacles include U.S. Pat. No. 4,763,809, issued to Miller et al., U.S. Pat. No. 4,440,321, issued to Campbell et al., U.S. Pat. No. 4,363,417, issued to Rhoades et al, U.S. Pat. No. 3,306,486, issued to Martino et al., and U.S. Pat. No. 1,286,368, issued to Lucas.

Conventional trash receptacles commonly have a fixed receptacle body for containing rubbish and/or other items deposited therein. Because such conventional trash receptacles are not expandable, these receptacles must be frequently emptied. Also, no manner of facilitating trash compaction is provided for the majority of receptacles in use today. As a result, such receptacles are emptied more frequently and commonly contain less trash. Such a practice acts to increase the transportation and disposal costs for garbage removal within our communities.

Many systems have been developed for compacting and compressing trash. However, most of them are motor driven making them expensive, noisy, and large. Being designed to crush or compress everything put into them, they have more power than is required for most purposes. Those that are not motor driven are either primarily aimed at can crushing alone or, if for general trash collection, they are inefficient and costly.

One such example of a simple mechanical means for trash compaction is disclosed in U.S. Pat. No. 5,220,866 issued to Mason, Jr. et al. The '866 patent discloses a container for compacting trash comprising a portion of its sides being formed of resilient horizontal pleated material throughout the circumference thereof and a downwardly movable plunger fitted therein. A need still remains for a more convenient trash compacting receptacle that may be scalable to sizes ranging from small domestic trash cans to large industrial garbage cans.

While the use of replaceable liners within conventional trash receptacles is a sanitary and efficient way to dispose of garbage over time, removal of the refuse liner from the housing of the permanent receptacle can be difficult and dangerous to one's health.

A problem occurs when removing a flexible, collapsible trash liner from its receptacle in that a vacuum seal is created in the vacant space immediately below the departing flexible trash liner making it more difficult to remove the flexible, collapsible trash liner because the greater ambient air pressure holds the flexible, collapsible trash liner within the trash receptacle. An additional problem occurs when filling a flexible, collapsible trash liner which is mounted within a trash receptacle in that the air trapped between the flexible, collapsible trash liner and the interior walls of the trash receptacle prevents the flexible, collapsible trash liner from assuming a ready and full configuration.

Traditionally, the refuse liner must be lifted up and over the rim of the receptacle. The vertical forces required to accomplish this task and break any created vacuum seal are significant and may cause injury to many users. The weak and infirm, along with the young and elderly, find it difficult to generate such vertical forces upon the refuse liner.

The bending and tugging at the replaceable liner is a tedious and bothersome task, due to the vacuum created between the liner and the sides of the receptacle. Devices in the previous art attempt to address this problem by providing various vacuum release means. U.S. Pat. No. 4,294,379, issued to Bard, and U.S. Pat. No. 5,375,732, issued to Bowers et al., disclose air conduits directed within the receptacle side walls. U.S. Pat. No. 6,594,876, issued to Stastny, discloses a method of attaching an air conduit through a side wall to the bottom of a trash receptacle.

Yet another problem associated with trash receptacles that use replaceable liners is the lifting of the receptacle during removal of the liner. U.S. Pat. No. 5,390,812, issued to Spiro, and U.S. Pat. No. 5,163,579, issued to Jones, disclose footpads that retract along the sides of the receptacle and can be extended to lay flat against the ground, thus providing a means of retaining the receptacle against the floor using one's foot.

Although a variety of receptacles are known, none are specifically directed to a receptacle that provides laterally expandable side walls that allow for the insertion of a greater volume of items therein and extends the time period between necessary liner removals. Moreover, a need further exists for a device that eliminates a vacuum seal which may develop in the space between a receptacle and an optional replaceable liner. Also, a need still further exists for a receptacle that provides a necessary stabilizing force against the receptacle during liner removal. The device of the present invention substantially fulfills these needs.

A search of the prior art did not disclose any patents or patent applications that read directly on the claims of the instant invention. Consequently, a need has been felt for providing an apparatus which overcomes all of the problems and limitations cited above.

BRIEF SUMMARY OF THE INVENTION

In view of the foregoing disadvantages inherent in the known types of receptacles now present in the prior art, the present invention provides a new laterally expandable receptacle construction wherein the device can provide for both the storage of additional item volume therein and ease of removal of an optional loaded receptacle liner there from. While the discussed prior art and examples below may generally refer to trash receptacles, the scope of the present invention may obviously extend to a great may arts, including but not limited to linens, laundry, recyclables, grain, paper products, wet/dry goods, and the like. As such, the general purpose of the present invention, which will be described subsequently in greater detail, is to provide a new laterally expandable receptacle apparatus which has many of the advantages of the receptacle structures mentioned heretofore in addition to many novel features that result in a laterally expandable receptacle which is not anticipated, rendered obvious, suggested, or even implied by any of the prior art container structures, either alone or in any combination thereof.

To attain this, the present invention generally comprises a laterally expandable receptacle for permitting the additional storage and providing easy removal of items such as refuse, laundry, recyclables, an optional receptacle liner, and the like, there from. The inventive device may generally include, but is not limited to, a wide variety of expandable means, a structural configuration to eliminate a vacuum seal, and a structure to assist in maintaining a stabilizing force against the receptacle during removal of at least one item therein, such as an optional liner.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in a variety of means. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the purpose of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

As such, the present invention provides for a laterally expandable receptacle comprising a base member having a perimeter, laterally expandable side walls having a lower portion circumscribing the perimeter of the base member and projecting upwardly therefrom, the laterally expandable side walls further comprising a resilient expansion means, and a rim in communication with an upper portion of the laterally expandable side walls.

DETAILED DESCRIPTION OF THE INVENTION

Figure 1A:
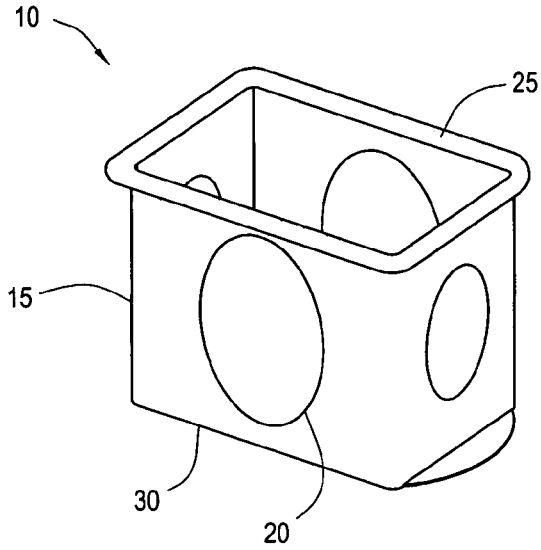
FIG. 1*a* depicts a perspective view of an embodiment of the present invention having a rectangular cross-sectional configuration.

Accordingly the reader will see that the present invention provides for a broad scope of laterally expandable receptacles 10 as described herein, and legal equivalents thereof. An expandable receptacle of the present invention generally comprises laterally expandable side walls 15, resilient expansion means 20, a rim 25, and a base member 30.

The laterally expandable side walls 15 of the present invention comprise a resilient expansion means 20 that allows for an enhanced storage capacity of the receptacle 10. Such resilient expansion means 20 may be incorporated into the surface of the laterally expandable side walls 15 and/or into the corners where the laterally expandable side walls 15 intersect. In this manner, a greater volume of items, including but not limited to trash, linen, laundry, recyclables, paper products, grains, wet/dry goods, and the like may be stored within the receptacle 10 before removal of at least one item, including an optional replaceable liner, is required. In addition, the resilient nature of the expansion means 20 further provides a compressive force on the items stored within the receptacle 10 of the present invention. This compressive force reduces the overall volume of the stored items and further increases the holding capacity of the receptacle 10 of the present invention. Garbage transport, landfill storage, recycling centers, home laundry methods and other such related processes are greatly enhanced by the compressive, larger-capacity storage device provided for by the present invention.

Figure 1B:
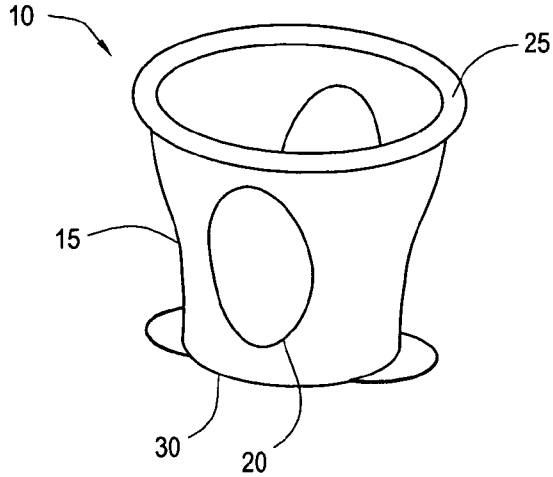
FIG. 1*b* depicts a perspective view of an embodiment of the present invention having a circular cross-sectional configuration.
Figure 1C:
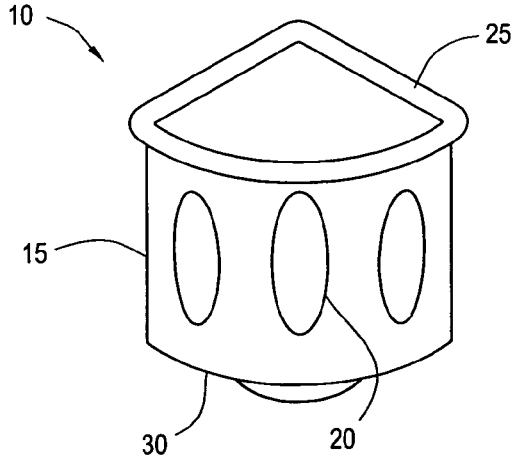
FIG. 1*c* depicts a perspective view of an embodiment of the present invention having a wedge-shaped cross-sectional configuration.

The laterally expandable side walls 15 of the present invention may have a wide array of cross-sectional configurations including, but not limited to, square, rectangle (see FIG. 1*a*), circular (see FIG. 1*b*), wedge-shaped (see FIG. 1*c*), triangular, oblong, egg-shaped, oval, pentagonal, hexagonal, octagonal, and any other trash receptacle configurations known within the art. The receptacle 10 and its laterally expandable side walls 15 may be comprised of plastic, metal, textiles or any other materials known within the art. Plastic is a preferred material due to its low cost, high durability, and its ability to be repeatedly cleaned and re-used. When the laterally expandable side walls 15 of the present invention are comprised of flexible material that is unable to maintain its own structural shape, rigid posts may be placed in each corner or spaced about the circumference of a circular receptacle 10 of the present invention to provide the necessary side wall 15 support. An upper portion of the laterally expandable side walls 15 is in communication with the rim 25, and a lower portion of the laterally expandable side walls 15 is in communication with, and projects upwardly from, the base member 30.

Figure 2A:
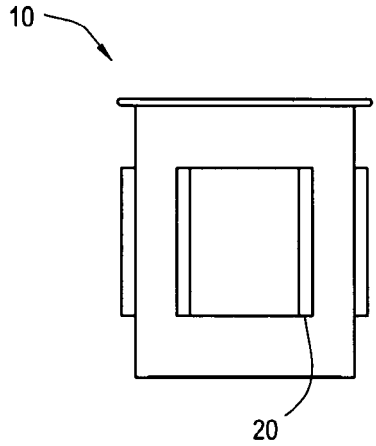
FIG. 2*a* depicts a side view of an embodiment of the present invention wherein the resilient expansion means comprises a plurality of box pleats.
Figure 2B:
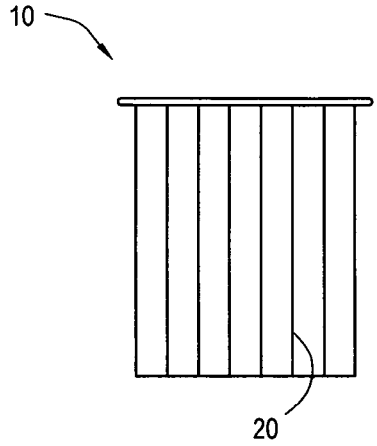
FIG. 2*b* depicts a side view of an embodiment of the present invention wherein the resilient expansion means comprises an accordion cross-sectional configuration.
Figure 2C:
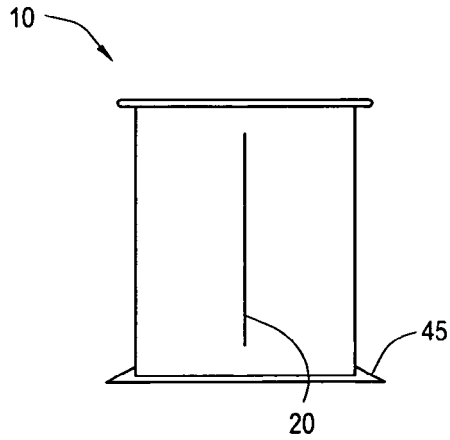
FIG. 2*c* depicts a side view of an embodiment of the present invention wherein the resilient expansion means comprises at least one slit.
Figure 2D:
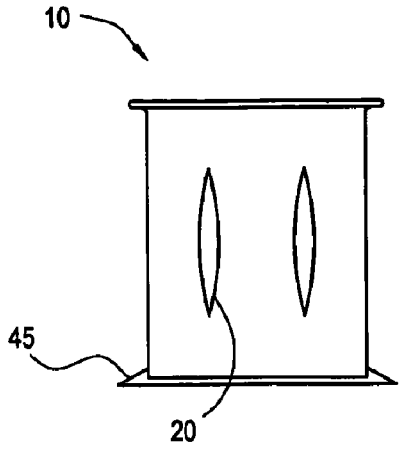
FIG. 2*d* depicts a side view of an embodiment of the present invention wherein the resilient expansion means comprises at least one aperture.
Figure 2E:
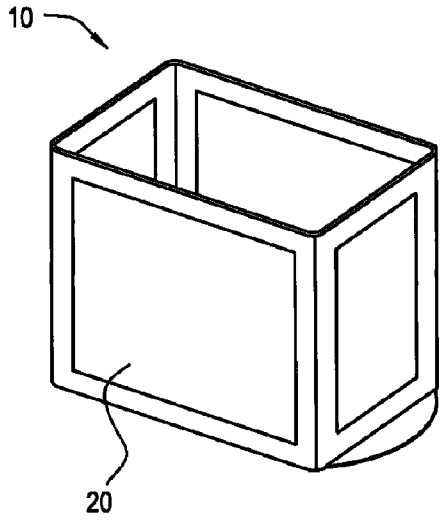
FIG. 2*e* depicts a perspective view of an embodiment of the present invention wherein the resilient expansion means comprises side walls composed of an expandable material.
Figure 2F:
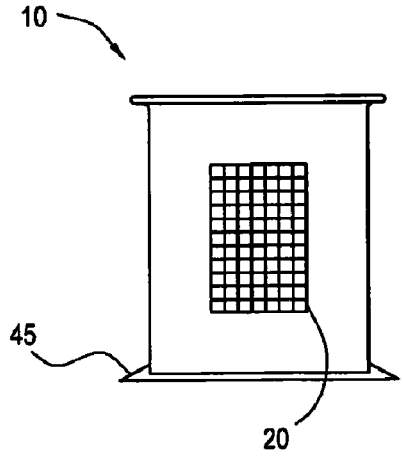
FIG. 2*f* depicts a side view of an embodiment of the present invention wherein the resilient expansion means comprises expandable material covering at least one aperture.
Figure 2G:
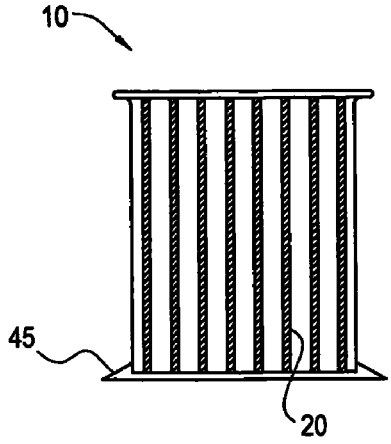
FIG. 2*g* depicts a side view of an embodiment of the present invention wherein the resilient expansion means comprises flexible cords.

Expansion means 20 of the present invention may comprise a variety of embodiments including, but not limited to, at least one pleat (i.e. box pleat (see FIG. 2*a*), accordion pleat, and all pleats known within the art), an accordion configuration (see FIG. 2*b*), at least one slit (see FIG. 2*c*), at least one aperture (see FIG. 2*d*), an expandable material (e.g. rubber, PVC, a stretchable membrane, elastic material, and the like) (see FIG. 2*e*), an expandable material covering at least one aperture (see FIG. 2*f*), flexible cords (see FIG. 2*g*), and all legal equivalents thereof. In use, as additional items are compressed in the receptacle 10 the respective expansion means 20 allows for lateral expansion of the receptacle's side walls 15 allowing for the storage of the additional items. The individual structural properties of the chosen expansion means 20 each provide for expansion in their own way. Slits (see FIG. 2*c*) and apertures (see FIG. 2*d*) may allow for and facilitate expansion of the laterally expandable side walls 15. Likewise, pleats (see FIG. 2*a*), an accordion structure (see FIG. 2*b*), expandable material (see FIG. 2*e*), and flexible cords (see FIG. 2*g*) may allow for a "bulging" expansion of the laterally expandable side walls given each unique structure. As an example, FIG. 2*e* depicts solid support structures along each edge and corner of the receptacle 10, wherein each side wall 15 may comprise an expandable material that allows for lateral "bulging" of the side walls 15 as a greater quantity of items are disposed therein.

Figure 3A:
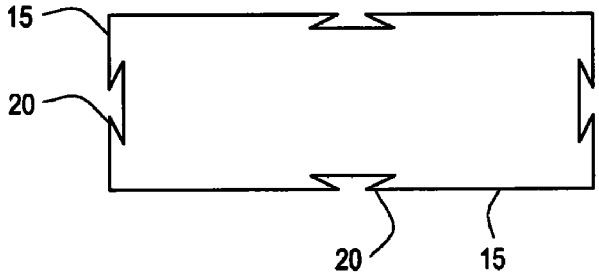
FIG. 3*a* depicts a top view of one embodiment of the present invention having at least one resilient expansion means in each laterally expandable side wall of the receptacle.
Figure 3B:
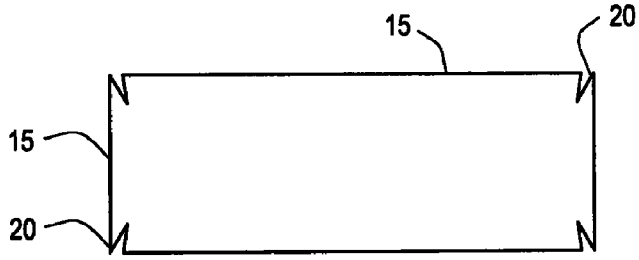
FIG. 3*b* depicts a top view of one embodiment of the present invention having at least one resilient expansion means in each corner of the receptacle.
Figure 3C:
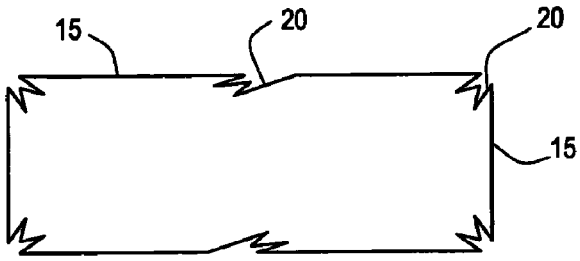
FIG. 3*c* depicts a top view of one embodiment of the present invention having a resilient expansion means in at least one laterally expandable side wall and each corner of the receptacle.

In a preferred embodiment, as depicted in FIG. 3*a*, at least one expansion means 20 is disposed within each laterally expandable side wall 15 of the receptacle 10. Alternatively or additionally, as depicted in FIGS. 3*b* and 3*c*, expansion means 20 may be disposed within at least one corner of the laterally expandable side walls 15 of the receptacle 10. Expansion means 20 may further be disposed about the circumference of a circular cross-sectional embodiment of the present invention, where corners and multiple side wall 15 surfaces are not present.

The rim 25 of the present invention may be adapted to allow for removal of items therein that have laterally expanded the side walls 15. In one embodiment the rim 25 may have a larger diameter than any other portion of the receptacle 10, including the laterally expandable side walls 15 and the base member 30. In this manner, the rim 25 will not interfere or act as a "bottle neck" when items are removed from a full receptacle 10 of the present invention. In a second embodiment, the rim 25 may be expandable, allowing for the removal of items from a full receptacle 10. Rim 25 may be expandable in any of the same means as described for the expansion means 20. Preferably, the rim 25 may comprise an accordion configuration that allows for further expansion of the rim 25 as an outward force is applied thereon. Further, an expandable rim 25 embodiment may be held in a closed configuration by a rim securing means until items are to be removed. During item removal, the rim securing means may be released and the rim may then expand and more easily allow items to be removed from the receptacle 10. The rim securing means may comprise a wide variety of structures including, but not limited to, an expandable unitary o-ring, cord, band or strap and/or an embodiment of an o-ring, cord, band, or strap incorporating a releasable connector. The rim securing means may also comprise complimentary fasteners disposed on distant portion of the expandable rim 25. When the expandable rim is in a closed configuration, the complimentary fasteners may be engaged with one another to maintain a closed rim configuration. When items are to be removed, the complimentary fasteners may be disengaged from one another allowing for the rim to expand and further facilitating item removal.

Figure 4:
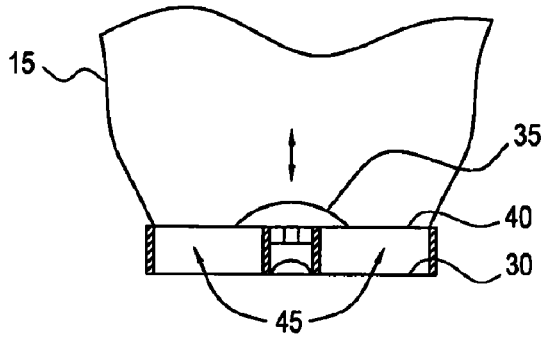
FIG. 4 depicts a side view of one embodiment of the present invention having a check release valve disposed through the floor member and at least one foot recess region.

As depicted in FIG. 4, a receptacle 10 of the present invention may further comprise a pressure release means 35. Pressure release means 35 of the present invention may comprise a variety of embodiments including, but not limited to, at least one check valve, at least one ball valve, at least one conduit, at least one channel, at least one pleat, an expansion means 20, and all legal equivalents thereof. The inherent structure of certain expansion means 20, such as an accordion configuration, at least one slit, at least one aperture, a breathable expandable material (e.g. rubber, PVC, a stretchable membrane, elastic material, and the like), a breathable expandable material covering at least one aperture, and flexible cords, may allow for ambient air to pass between the receptacle 10 and at last one item stored therein, such as an optional inserted replaceable liner, so as too eliminate a vacuum seal therebetween.

A pressure release means 35 may be disposed through any structural surface of the present invention. In a preferred embodiment, a pressure release means 35 in the form of a valve may be disposed within a floor member 40 or base member 30 of the receptacle 10 of the present invention to eliminate any vacuum seal that may form between the inner surfaces of the receptacle 10 and at last one item stored therein, such as an optional replaceable liner. The floor member 40 may be disposed above and parallel to the base member 30 creating an open space therebetween. In this manner, the valve pressure release means 35 may allow ambient air from the open space region to enter the lower portion of the receptacle 10 preventing a vacuum seal. One or more valve pressure release means 35 may be disposed within the floor member 40, more preferably, a valve pressure release means 35 is disposed in every corner of the floor member 40 or evenly spaced around the perimeter of a circular-shaped floor member 40. Alternatively or additionally, at least one pressure release means 35 may be disposed within one or more laterally expandable side walls of the present invention.

Figure 5:
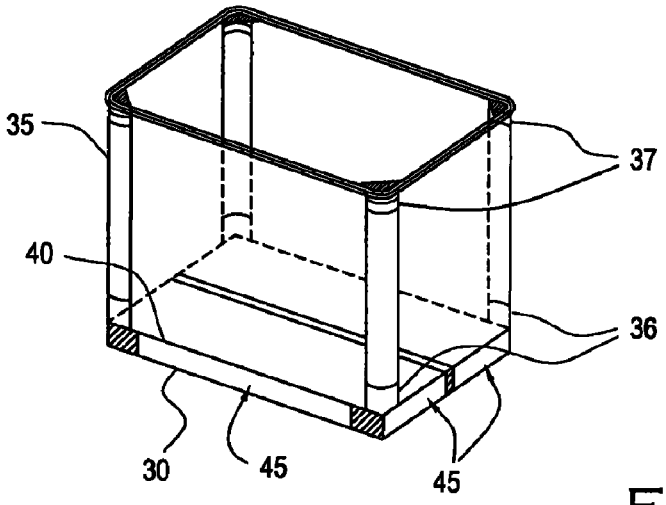
FIG. 5 depicts a perspective view of one embodiment of the present invention having at least one foot recess region and a pressure release means in each corner of the receptacle.

Alternatively, a conduit or channel may serve as the pressure release means 35 and communicate ambient air to the lower region of the receptacle 10. Such communication may occur through the laterally expandable side walls 15, the rim 25 and/or the floor member 40 or base member 30. In one possible embodiment depicted in FIG. 5, at least one channel is vertically disposed in at least one corner of the receptacle 10 along the inner surfaces of the respective laterally expandable side walls 15. The bottom portion 36 of the channel being open to the lower inner region of the receptacle 10 and the upper portion 37 of the channel being open to the ambient air. The upper portion 37 of the channel may vent to the ambient air through its upper most end or through an aperture extending laterally through the expandable side wall(s) 15. In a preferred embodiment, a channel is vertically disposed in each corner of the receptacle 10 (see FIG. 5) or, in circular receptacles 10, a plurality of channels are evenly spaced around the circumference of the receptacle 10.

Figure 6:
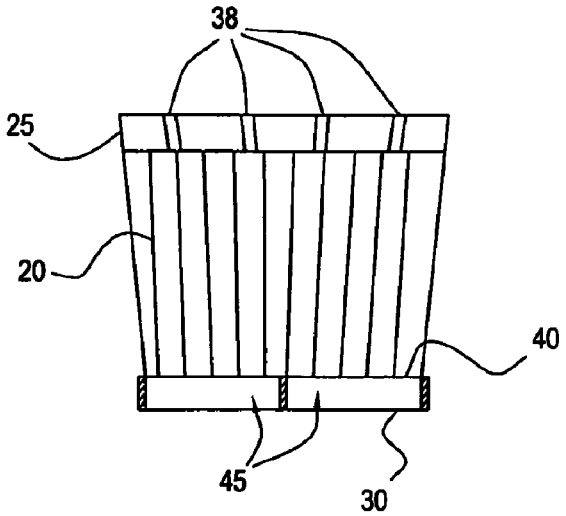
FIG. 6 depicts a side view of one embodiment of the present invention having at least one foot recess region and at least one pressure release means through the rim of the receptacle.
Figure 7:
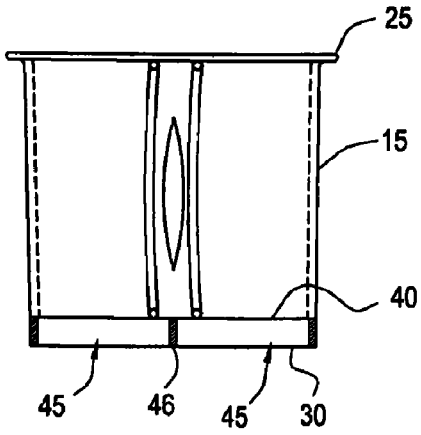
FIG. 7 depicts a side view of one embodiment of the present invention having at least one foot recess region.

Additionally, as depicted in FIG. 6, a pleat being utilized as an expansion means 20 may simultaneously serve as a pressure release means 35. The folded structure of such a pleat itself may allow ambient air to pass around at least one item inserted within the receptacle 10, thus eliminating the formation of a vacuum seal during removal of such at least one item. Additionally, a plurality of holes 38 may be disposed extending through the top surface of the rim 25 to further assist in venting air both into and out of the lower inner region of the receptacle 10 during insertion and/or removal of at least one item.

A receptacle 10 of the present invention may still further comprise a stabilization means 45 for retaining the receptacle 10 in contact with the ground during removal of at least one item stored therein, such as an optional liner. Within the scope of this description, the definition of the term "ground" may include but is not limited to a floor, deck platform, substrate, street, pavement, concrete, or any other known base surfaces on which storage receptacles may be disposed. Stabilization means 45 may comprise a variety of structures including, but not limited to, a flange disposed about the perimeter of the base member 30 and/or the lower portion of the laterally expandable side walls 15 (see FIGS. 2*c*, 2*d*, 2*f*, 2*g*, and 10) and at least one foot recess region disposed within the space between the floor member 40 and the base member 30 (see FIGS. 4-8 and 13). In these embodiments, at least one foot of a user may be placed over the flange structure or within the at least one foot recess region to provide a stabilizing force on the receptacle 10 during the upward removal of at least one item stored therein, such as an optional liner. In this manner, the receptacle 10 is stabilized while allowing both hands of a user to remain free for additional manipulations.

Figure 8:
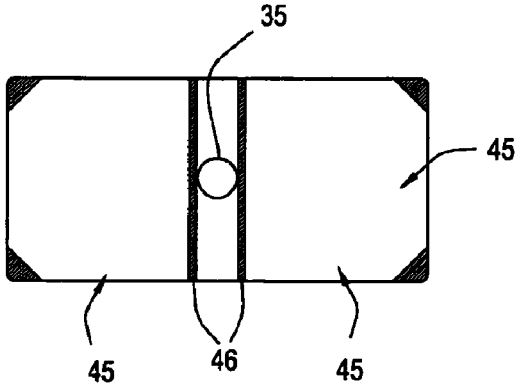
FIG. 8 depicts a bottom view of one embodiment of the present invention having at least one foot recess region.
Figure 10:
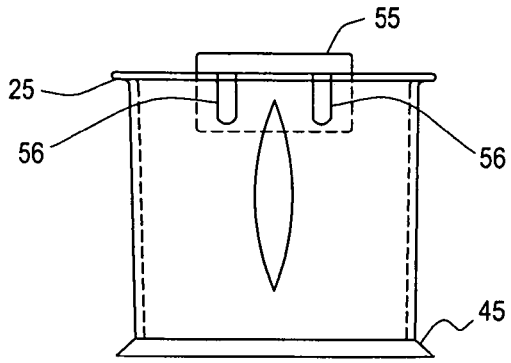
FIG. 10 depicts a side view of one embodiment of the present invention having a compressing means capable of hanging about the rim of the receptacle.
Figure 11:
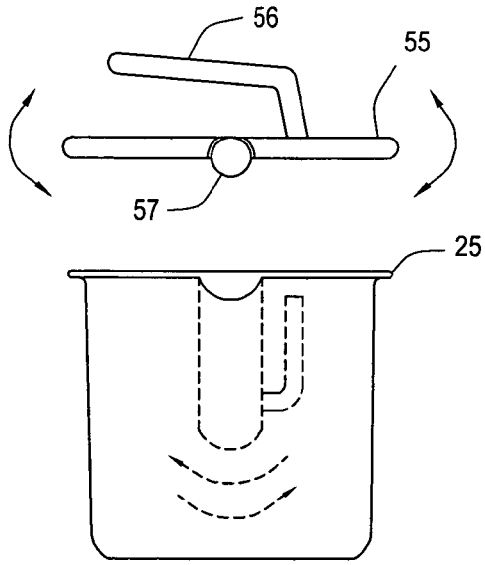
FIG. 11 depicts a side view of one embodiment of a compression means of the present invention being used as a rotatable, compressing lid.
Figure 12:
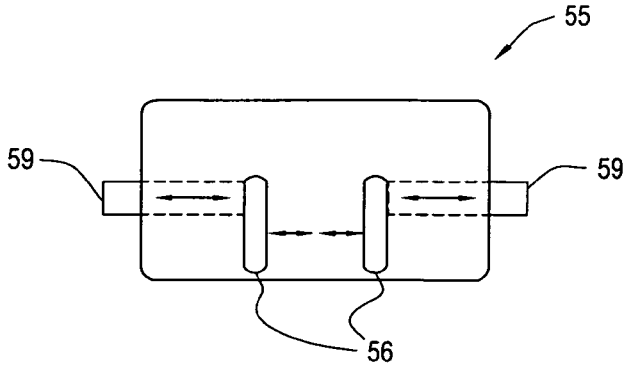
FIG. 12 depicts a top view of one embodiment of a compressing means of the present invention having extendable and retractable tabs each in communication with a respective handle.

When the stabilization means 45 is at least one foot recess region, the structural integrity of the receptacle 10 must still be maintained. As shown in FIGS. 4-8 and 13, the incorporation of at least one foot recess region produces holes through the laterally expandable side walls 15 allowing at least one foot of a user to be placed on the upper surface of the base member 30. Preferably, a majority of the side wall 15 material located between the floor member 40 and base member 30 may be removed to provide a plurality of foot recess regions on all sides of the receptacle 10. In one preferred embodiment, the side wall 15 material connects the floor member 40 to the base member 30 layer only at the corners of the receptacle 10. Such an embodiment leaves the remaining lengths of each respective side wall 15 available for replacement by foot recess regions capable of acting as stabilization means 45. If greater structural strength is desired, vertical struts 46 may be disposed perpendicular to and between the floor member 40 and base member 30. As an example in a receptacle 10 having a rectangular cross-section, vertical struts 46 may bisect one or both sets of opposing sides. Such an embodiment would provide two distinct foot recess regions on each bisected side of the receptacle 10. In another embodiment as depicted in FIGS. 8 and 10, parallel vertical struts 46 may border and protect a pressure release means 35 such as a valve, and further provide an open channel to external ambient air.

Figure 9:
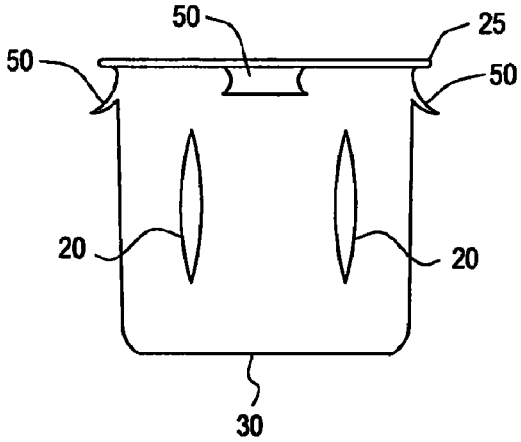
FIG. 9 depicts a side view of one embodiment of the present invention having a plurality of liner securing means disposed about the upper portion of the laterally expandable side walls.

A receptacle 10 of the present invention may yet further comprise a liner securing means 50 for communicating with and holding the mouth portion of an optional replaceable liner about the rim 25 of the receptacle 10. Liner securing means 50 may comprise a variety of structures including, but not limited to, an expandable strap, a releasable strap, an expandable unitary o-ring, cord, or band disposed about the upper portion of the laterally expandable side walls 15 or rim 25. Liner securing means 50 may also comprise at least one hole, at least one slit, at least one tab, or at least one small aperture (see FIG. 10) disposed about the upper portion of the laterally expandable side walls 15 or rim 25 for receiving and securing a portion of the optional liner there through. In a preferred embodiment, four evenly spaced holes, slits or small apertures may be evenly spaced about the upper circumference of the receptacle 10. As depicted in FIG. 9, a liner securing means 50 may also comprise at least one tab extending outwardly and/or downwardly from the rim 25 or upper portion of the laterally expandable side walls 15. In a preferred embodiment, four tabs are evenly spaced about the upper circumference of the receptacle 10 for receiving and securing a portion of the optional replaceable liner.

A receptacle 10 of the present invention may yet further comprise a compressing means 55 for providing a compressive force to items contained within the receptacle 10. Compressing means 55 of the present invention may comprise a variety of embodiments including, but not limited to, a planar structure preferably having a perimeter smaller that, but shape substantially similar to, the cross-sectional shape of the receptacle 10 and further possessing at least one handle disposed on its upper surface. The at least one handle 56 may be of any practical shaped, preferably U-shaped or L-shaped, and be attached to the upper surface of the compressing means 55. Preferably, two L-shaped handles 56 disposed in parallel may be used to provide hand grips that may also function as hooks that allow for the compressing means 55 to be hung about the rim 25 of the receptacle 10 when not in use. Alternatively, the two handles 56 need not be parallel or L-shaped so long as their structure provides for a hooking function about the rim 25 of the receptacle 10.

The compressing means 55 may also function as a lid for the receptacle 10 of the present invention. For proper compressive use, the compressing means 55 must fit within the boundaries of the rim 25. However to also function as a receptacle 10 lid, structures must be included that allow for the compressing means 55 to be held along the plane bounded by the rim 25. In one embodiment a fixed rod 57 may be attached to and extend along the axial length of the compressing means 55 and may be seated within semi-circular groove 58 defined within opposing edges of the rim 25. The compressing means 55 may then serve as a lid and may further be rotated about the fixed rod 57 to provide a compressive force on items there below. In a second embodiment, the fixed rod 57 may be replaced by retractable tabs 59 that may extend beyond the outer perimeter of the compressing means 55 along its axial length. The retractable tabs 59 may be fixed to respective handles 56 on the compressing means 55, so that sliding the handles 56 closer together acts to retract the tabs 59 while moving the respective handles 56 further apart acts to extend the tabs 59. In this manner, the compressing means 55 may be forced down into the receptacle 10 when the tabs 59 are in a retracted stated or used as a lid when the tabs 59 are in an extended state. Additionally, the tabs 59 may have a circular cross section allowing for rotational compression by the compressing means 55 when in the lid position and seated in the groove 58, as described above.

Figure 13:
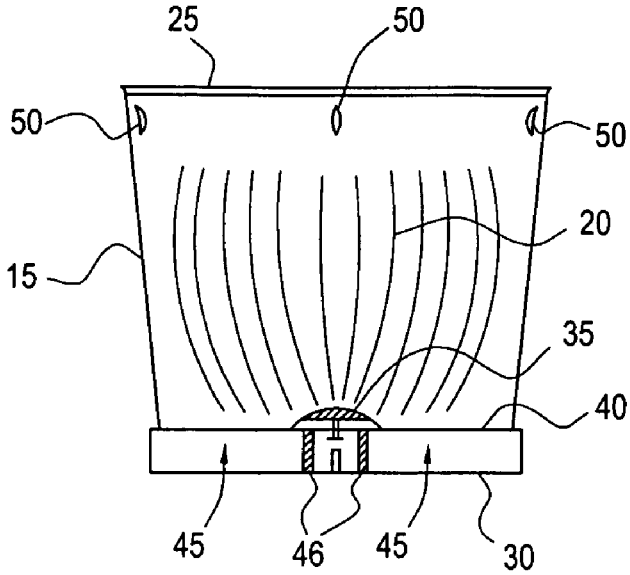
FIG. 13 depicts a side view of a preferred embodiment of the present invention.

A preferred embodiment of the present invention is illustrated in FIG. 13. In use, such an embodiment may comprise at least one pleated or slit expansion means 20. To aid in the removal of the additional item volume capable of being stored within the laterally expandable side walls 15, the rim 25 may have a diameter greater than the diameter of any other portion of the receptacle 10. Such a configuration facilitates the removal of items from the receptacle 10 and may alleviate issues wherein a narrow rim 25 may become a wedging point or "bottle neck" for a wider volume of items there below. To further aid in the removal of at least one item stored within the receptacle 10 (e.g. an optional replaceable liner), a pressure release means 35 (e.g. a check release valve) may be disposed through the floor member 40 to provide air access both to and from the inner lower region of the receptacle 10. Therefore during removal or insertion of an optional removable liner, the pressure release means 35 serves to equalize the air pressure within the receptacle 10 by allowing either air inflow or air outflow as dictated by the surrounding air pressure. An embodiment of a liner securing means 50, such as small apertures as shown, may be further included about the rim 25 or upper region of the laterally expandable side walls 15 to receive and secure portions of the mouth end of the optional replaceable liner. Such a structure eliminates both the problem of the replaceable liner mouth falling within the receptacle 10 and the need to tie the replaceable liner to itself in order to remove slack and achieve a snug fit about the rim 25 of the receptacle 10. When removing an optional replaceable liner, a stabilization means 45, such as a plurality of foot recess regions shown, may assist in maintaining the receptacle 10 in contact with the ground. Such a foot recess region may be formed by disposing a floor member 40 above and parallel to the base member 30. The floor member 40 may be disposed a sufficient height above the base member 30 to allow for the toes of a user's foot or shoe to fit therebetween. Additionally, portions of the side wall 15 may be removed to allow access to the open region between the floor member 40 and base member 30. A plurality of portions of the side walls 15 may be removed about the lower perimeter of the receptacle 10 to provide for a plurality of stabilization means 45 as depicted. Further reinforcing structures, such as vertical struts 46, may be incorporated to assist in supporting both the weight of the receptacle 10 and the trash therein. As depicted in FIG. 13, the vertical struts 46 may be positioned to protect a pressure release means 35 and/or provide an unobstructed air channel to the pressure release means 35.

While the above description contains much specificity, these should not be construed as limitations on the scope of any embodiment, but as exemplifications of the presently preferred embodiments thereof. Many other ramifications and variations are possible within the teachings of the various embodiments.

Thus the scope of the invention should be determined by the appended claims and their legal equivalents, and not by the examples given.

What is claimed is:

1. A laterally expandable receptacle, comprising:

a base member having a perimeter;

laterally expandable side walls having a lower portion circumscribing said perimeter of said base member and projecting upwardly therefrom, said laterally expandable side walls further comprising at least one pleat;

a rim in communication with an upper portion of said laterally expandable side walls; and a lid having a fixed rod disposed along the axial length of said lid, wherein said fixed rod of said lid is seated within opposing semi-circular grooves within said rim and said lid may be rotated about said fixed rod to compress items below said lid.

2. The laterally expandable receptacle of claim 1, wherein the diameter of said rim is greater than the diameter of said laterally expandable side walls and the diameter of said base member when said receptacle is empty.

3. The laterally expandable receptacle of claim 1, wherein said laterally expandable receptacle is of a general cross-sectional configuration selected from the group consisting of rectangular, square, circular, triangular, wedge-shaped, oblong, egg-shaped, oval, pentagonal, hexagonal, and octagonal.

4. The laterally expandable receptacle of claim 1, wherein said receptacle further comprises:

a floor member having a perimeter circumscribed by said laterally expandable side walls, wherein said floor member is disposed above and parallel to said base member; and at least one foot recess region disposed within said lower portion of said laterally expandable side walls and between said floor member and said base member, said at least one foot recess region allowing for said receptacle to remain in contact with the ground during removal of at least one item stored within said receptacle.

5. The laterally expandable receptacle of claim 1, wherein said receptacle further comprises:

at least one liner securing means disposed about said upper portion of said laterally expandable side walls for holding a mouth portion of a replaceable liner about said rim of said receptacle, wherein said at least one liner securing means is selected from the group consisting of at least one hole, at least one slit, at least one tab, at least one small aperture, a cord, a band, an expandable strap, a releasable strap, and an expandable unitary o-ring.

6. The laterally expandable receptacle of claim 1, wherein said receptacle further comprises:

at least one pressure release means for eliminating a potential vacuum seal between said receptacle and at least one item stored therein, wherein said at least one pressure release means is selected from the group consisting of at least one check valve, at least one ball valve, at least one conduit, at least one channel, at least one pleat, and a plurality of holes.

7. The laterally expandable receptacle of claim 1, wherein said at least on pleat is incorporated into at least one corner of said laterally expandable receptacle.

8. The laterally expandable receptacle of claim 1, wherein said at least on pleat is incorporated into at least one of said side walls of said laterally expandable receptacle.

9. The laterally expandable receptacle of claim 1, wherein said at least on pleat is incorporated into both at least one corner of said laterally expandable receptacle and at least one of said side walls of said laterally expandable receptacle.

10. The laterally expandable receptacle of claim 6, wherein said at least one pressure release means comprises a plurality of holes extending through said rim and is capable of venting air from within said laterally expandable receptacle when a receptacle liner is disposed therein.

11. The laterally expandable receptacle of claim 1, wherein said receptacle is capable of storing wet goods.

12. The laterally expandable receptacle of claim 1, wherein said rim comprises a fixed diameter.

13. The laterally expandable receptacle of claim 1, wherein said at least one pleat is vertically oriented.

14. The laterally expandable receptacle of claim 13, wherein said at least one pleat spans from said rim to said base member.

15. The laterally expandable receptacle of claim 1, wherein said rim is expandable via said at least one pleat extending from said laterally expandable side walls to said expandable rim and said expandable rim further comprises a rim securing means for releasably holding said expandable rim in a closed configuration.

16. The laterally expandable receptacle of claim 15, wherein said rim securing means comprises a band.

17. The laterally expandable receptacle of claim 5, wherein said liner securing means is disposed about said rim and said liner securing means is selected from the group consisting of a band and a strap.

* * * * *